United States Patent [19]

Moertel

[11] 4,034,444

[45] July 12, 1977

[54] SLIDE FASTENER STRINGER

[75] Inventor: George B. Moertel, Crawford, Pa.

[73] Assignee: Textron, Inc., Providence, R.I.

[21] Appl. No.: 539,644

[22] Filed: Jan. 9, 1975

[51] Int. Cl.[2] ..... A44B 19/10; A44B 19/40

[52] U.S. Cl. ..... 24/205.1 C; 24/205.16 C; 24/205.13 C

[58] Field of Search ..... 24/205.1 C, 205.13 C, 24/205.16 C, 205.1 R

[56] References Cited

U.S. PATENT DOCUMENTS

| | | | |
|---|---|---|---|
| 1,581,751 | 4/1926 | Marinsky | 24/205.16 C |
| 1,680,266 | 8/1928 | Galat | 24/205.16 R |
| 1,817,837 | 8/1931 | Poux | 24/205.16 R |
| 2,100,645 | 11/1937 | Hendley | 24/205.16 R |
| 3,484,906 | 12/1969 | Yosaida | 24/205.1 C |
| 3,665,561 | 5/1972 | Helmberger | 24/205.16 C |
| 3,667,089 | 6/1972 | Porepp | 24/205.13 C |
| 3,789,465 | 2/1974 | Moertel | 24/205.13 C |
| 3,831,228 | 8/1974 | Jakob | 24/205.16 C |
| 3,855,671 | 12/1974 | Fujisaki | 24/205.13 C |

FOREIGN PATENT DOCUMENTS

| | | | |
|---|---|---|---|
| R55,776 | 9/1958 | France | 24/205.16 R |
| 257,703 | 4/1949 | Switzerland | 24/205.16 R |
| 1,177,727 | 6/1970 | United Kingdom | 24/205.1 C |

*Primary Examiner*—Bernard A. Gelak

[57] ABSTRACT

A stringer for a slide fastener has a coupling element formed from a continuous filament with leg portions secured to a tape-like portion wherein an elongated member is interposed between the superimposed leg portions. The leg portions are provided with grooves, teeth, or the like, for interlocking with the elongated member to restrain longitudinal and transverse movement of the leg portions relative to the elongated member. The elongated member provides dimensional stability to the coupling element.

11 Claims, 13 Drawing Figures

FIG. 1
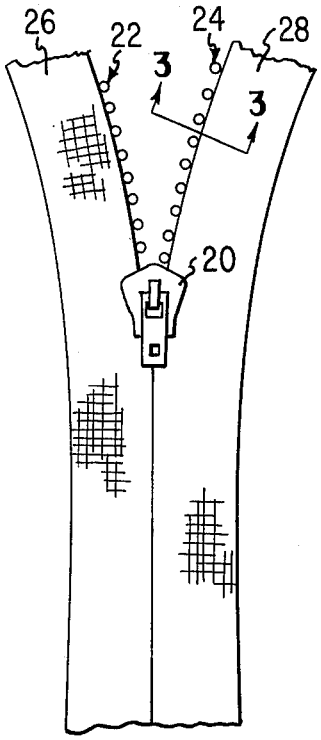
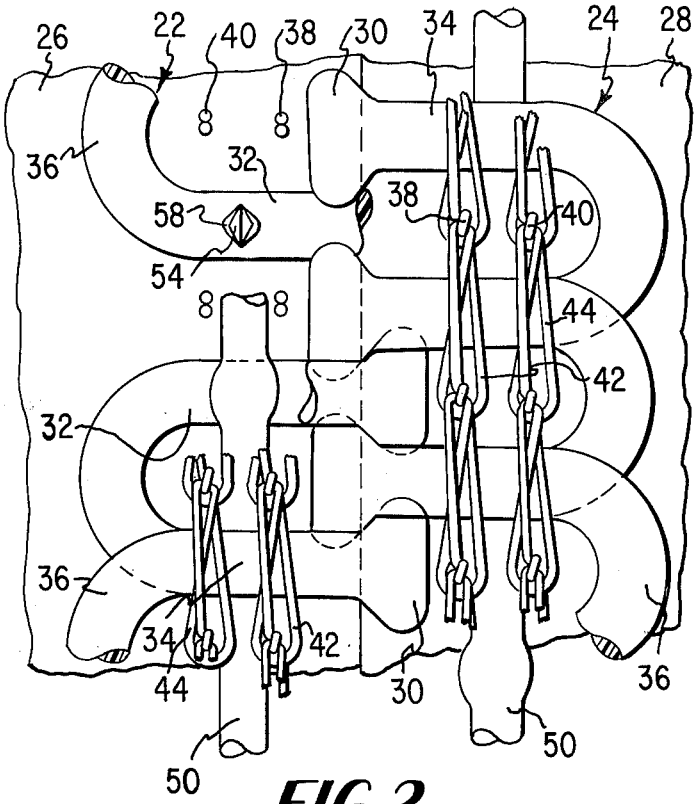
FIG. 2
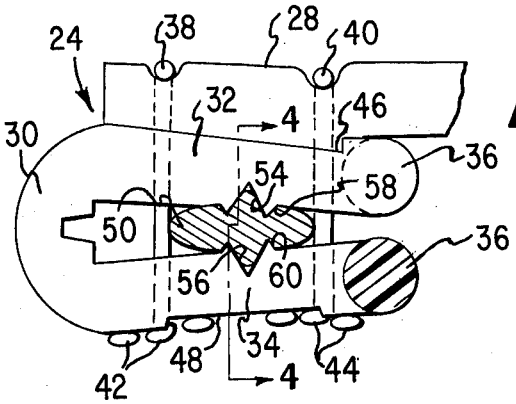
FIG. 3
FIG. 5
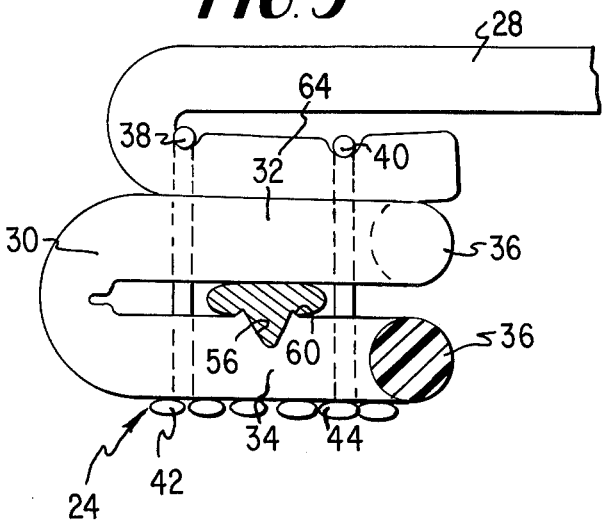
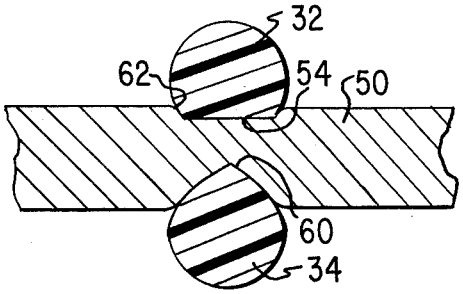
FIG. 4

FIG. 6
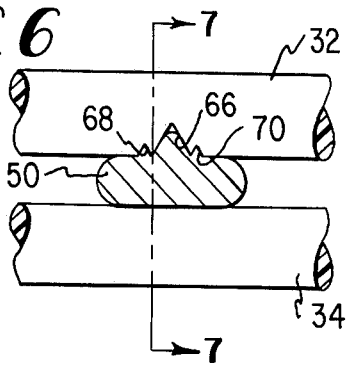
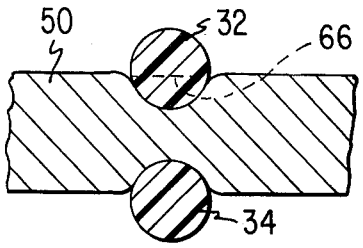
FIG. 7
FIG. 8
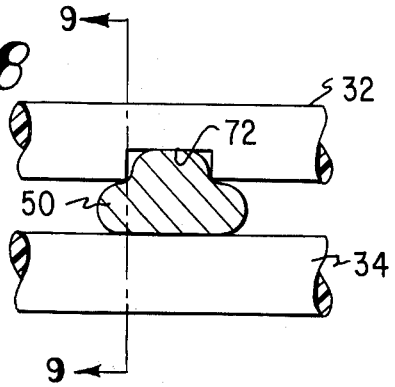
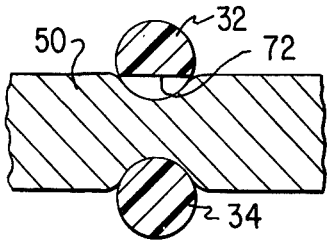
FIG. 9
FIG. 10
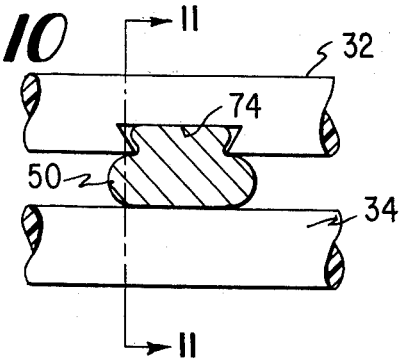
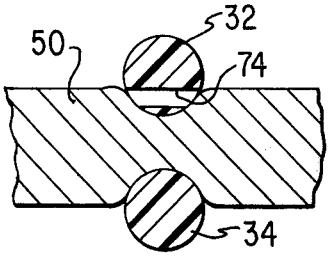
FIG. 11
FIG. 12
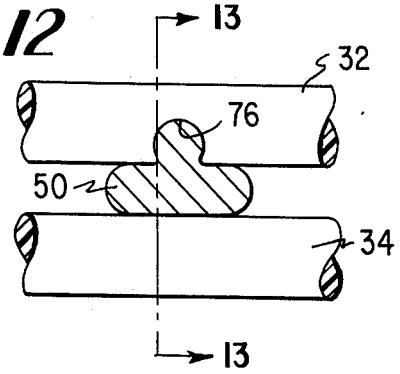
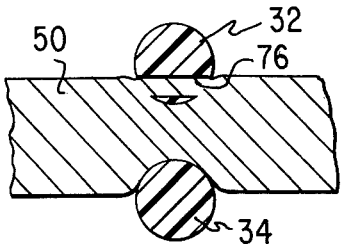
FIG. 13

SLIDE FASTENER STRINGER

BACKGROUND OF THE INVENTION

1. Field of the Invention

The invention relates to slide fasteners and particularly to slide fasteners having coupling elements formed from continuous filamentary materials secured to the adjoining edges of an opening and closing the opening.

2. Description of the Prior Art

Prior art slide fasteners, such as illustrated in U.S. Pat. Nos. 1,581,751, 3,283,379, 3,290,747, 3,359,604, 3,665,561, 3,750,260, 3,783,476, and 3,789,465, employ coupling elements formed from continuous filaments with leg portions of the coupling elements secured by stitching threads to adjacent edges of respective carrier tapes; such slide fasteners depend upon the carrier tapes to provide longitudinal and/or transverse dimensional stability to the filamentary coupling element. Thus, these prior art slide fasteners employed relatively heavy or strong and dimensionally stable tapes for supporting the filamentary interlocking elements. In certain types of garments, such as those formed from relatively sheer materials, knitted materials, or the like, the relatively heavy tapes of prior art slide fasteners degraded the appearance of the garments or their flexibility. Some of the prior art slide fasteners employed filler cords or elongated members extending between leg portions longitudinally in the filamentary coupling elements to aid in the attachment of the coupling elements by stitched or woven threads to edges of the tapes; such slide fasteners still depending primarily upon the strength and rigidity of the carrier tapes for longitudinal and transverse dimensional stability of the slide fastener stringers.

Great Britain patent specification No. 1,305,790 discloses a meander shape stringer having alternate short and long loops with a strip welded between the legs of the longer loops and the interconnecting curves of the shorter loops, the welded arrangement ensuring spacing between coupling elements; coupling elements having their leg portions all welded together are generally deficient in flexibility, ease of operation, reliability, economy of manufacture or the like.

SUMMARY OF THE INVENTION

The invention is summarized in that a stringer for a slide fastener includes a tape-like attachment portion; a coupling element disposed along one edge of the attachment portion and being formed from a continuous filament into successive coupling sections; each section having a head portion, a pair of leg portions extending from opposite sides of the head portion, and a connecting portion interconnecting to a leg portion of an adjoining section; thread means securing each section to the attachment portion; an elongated member extending in spaced relation to the attachment portion throughout the length of the coupling element between the pair of leg portions of each section and maintaining the pair of leg portions of each section in spaced relationship; the pair of leg portions of each section being disposed against the elongated member; and means formed on at least one of the pair of leg portions of each section and engaging the elongated member for restraining longitudinal and transverse movement of the one leg portion of each section relative to the elongated member.

An object of the invention is to construct a stringer for a slide fastener having continuous filamentary coupling elements which do not require dimensionally stable support tapes.

Another object of the invention is to eliminate the necessity of the supporting or tape portions of the slide fasteners meeting the functional requirements of longitudinal strength, coil stabilization, slider guidance and the like.

Still another object of the invention is to provide a continuous filamentary coupling element interlocked with an internal elongated member for stabilizing the longitudinal dimensions of the coupling element.

It is also an object of the invention to construct a fastener employing interlocking continuous filamentary coupling elements wherein elongated members within the coupling elements impart longitudinal and transverse strength to the coupling elements to enhance crosswise strength while improving flexibility of the fastener.

One feature of the present invention is that one of a pair of superimposed leg portions of a continuous filamentary coupling element is provided with a tooth, groove, or the like, which grips or mechanically interlocks with a resilient elongated member interposed between the leg portions.

An advantage of the invention is that an interposed longitudinal member in a filamentary coupling element forms an integral part thereof directly transferring longitudinal and transverse forces from head to head in the coupling element to insure consistent operation under high loading levels.

A further advantage of the invention is that an interposed resilient member controls the translation of forces between superimposed legs of a filamentary coupling element to provide improved operation under high stress loading.

Other objects, features and advantages of the invention will be apparent from the following description when taken in conjunction with the accompanying drawing.

BRIEF DESCRIPTION OF THE DRAWINGS

FIG. 1 is a plan view of a slide fastener in accordance with the invention.

FIG. 2 is a bottom detail view of a portion of a chain of the slide fastener of FIG. 1.

FIG. 3 is a cross section view taken along line 3—3 of FIG. 1.

FIG. 4 is a cross section view taken along line 4—4 of FIG. 3.

FIG. 5 is a view similar to FIG. 3 of a modified slide fastener in accordance with the invention.

FIG. 6 is a cross section view of an elongated member and a pair of leg portions of a coupling element in a second variation of the slide fastener in accordance with the invention.

FIG. 7 is a cross section view taken along line 7—7 of FIG. 6.

FIG. 8 is a cross section view of an elongated member and a pair of leg portions in a third variation of the slide fastener in accordance with the invention.

FIG. 9 is a cross section view taken along line 9—9 of FIG. 8.

FIG. 10 is a cross section view of an elongated member and a pair of leg portions in a fourth variation of the slide fastener in accordance with the invention.

FIG. 11 is a cross section view taken along line 11—11 of FIG. 10.

FIG. 12 is a cross section view of an elongated member and a pair of leg portions in a fifth variation of the slide fastener in accordance with the invention.

FIG. 13 is a cross section view taken along line 13—13 of FIG. 12.

DESCRIPTION OF THE PREFERRED EMBODIMENTS

As illustrated in FIG. 1, the present invention is embodied in a slide fastener including a slider 20 mounted for sliding movement along coupling elements indicated generally at 22 and 24 disposed along adjacent edges of respective attachment portions or planarly disposed tapes 26 and 28. The element 22 and the tape 26 form a left stringer while the element 24 and the tape 28 form a right stringer. The coupling elements 22 and 24 are capable of closing and opening with each other in response to movement of the slider 20.

As shown in FIG. 2, each of the coupling elements 22 and 24 is formed from a continuous filament, such as a polyester or nylon monofilament, into successive coupling sections each of which include a head portion 30, an upper leg portion 32, a lower leg portion 34, and a connecting or heel portion 36 interconnecting leg portions of adjoining sections. The filament has a cross section with a curved outer boundary forming a curved surface on the filament. The leg portions 32 and 34 of each section extend from respective upper and lower ends of the head portion 30 and are superimposed such that they extend parallel in a respective plane perpendicular to the adjoining edges of the tapes 26 and 28. As illustrated in FIGS. 2 and 3, the leg portions 32 and 34 of each coupling element 22 and 24 extend over one side of the respective tapes 26 and 28 contiguous the adjacent edges of the tapes 26 and 28 and are secured to the tapes by threads such as needle threads 38 and 40 and looper threads 42 and 44. Conveniently, each upper leg portion 32 has a triangular notch 46 into which the respective tapes 26 and 29 are drawn and secured by the threads 38 and 40 while the lower leg portion 34 have respective rectangular notches 48 with edges of the notches 48 engaged and covered by the looper threads 42 and 44 to prevent transverse movement of the tapes 26 and 28 relative to the respective coupling elements 22 and 24 and to prevent abrasion of objects which could otherwise be contacted by the edges of the notches 48.

The coupling elements 22 and 24 maybe a coil or ladder type such as the meander ladder type show in FIGS. 1, 2 and 3. In the meander ladder type, the connecting portions 36 of alternate sections extend in respective spaced planes parallel the tapes 26 and 28 and alternately interconnect upper leg portions 32 and lower leg portions 34 which also extend in the respective spaced planes parallel the tapes 26 and 28.

As shown in FIGS. 2, 3 and 4, an elongated member 50 having a generally round cross section extends between the leg portions 32 and 34 longitudinally in each of the coupling elements 22 and 24 parallel to the tapes 26 and 28 and spaced from the connecting portions 36. The elongated members 50 are formed from a material, such as a textile material, which is flexible and substantially more resilient or deformable in cross section than the filamentary material in the coupling elements 22 and 24. The elongated members are further selected to have a predetermined longitudinal dimensional stability or elasticity.

The leg portions 32 and 34 of each section have respective detents or grooves 54 and 56 and teeth or projections 58 and 60 formed by upset grooving the facing and curved surfaces of the leg portions 32 and 34 midway between ends of the leg portions 32 and 34. The grooves 54 and 56 are formed perpendicular to the longitudinal dimension of the respective leg portions 32 and 34 extend parallel the elongated members 50. The leg portions 32 and 34 are biased toward each other such that the elongated members 50 are engaged and distorted and are resiliently deformed so that the portions of the elongated members 50 engaged by the leg portions 32 and 34 are conformed to the topography of the surface portions in and around the grooves 54 and 56. The teeth 58 and 60 displace portions of the elongated members 50 to interlock therewith. The grooves 54 and 56 have V-shaped cross sections which have an area substantially less than the cross sectional area of the elongated flexible members 50 such that the members 50 are distorted inward by the walls of the grooves 54 and 56 to form abutment portions 62 engaging and interlocking with the sides of the leg portions 32 and 34 at the ends of the grooves 52 and 54. The grooves 54 and 56 and the teeth 58 and 60 have relatively sharp edges for gripping or biting into the elongated flexible members 50 both longitudinally and transversely. Planar surfaces forming sides of the grooves 54 and 56 and sides of the teeth 58 and 60 engage a substantial surface portion of the members 50 to form a wall tending to prevent movement of the elongated members 50 in a direction longitudinal of the leg portions 32 and 34. Further, segments of the leg portions 32 and 34 of each section between the connecting portions 36 and the teeth 58 and 60 are free of any restraint between such segments.

In addition to the interlocking structure of the leg portions 32 and 34 and the elongated members 50, the elongated members 50 may be bonded, such as by welding, by an adhesive, or the like, to the leg portions 32 and 34; the interlocking structure of the leg portions 32 and 34 greatly improving the strength of such bonds.

In operation of the slide fastener of FIGS. 1, the slider 20 bends the coupling elements 22 and 24 in the plane of the tapes 26 and 28 to open the spacing between the head portions 30 at the bends to allow interengagement or disengagement of the head portions of the coupling elements 22 and 24 to close or open the slide fastener by movement of the slider 20.

The elongated members 50 having deformed portions interlocking with the grooves 54 and 56 and the teeth 58 and 60 on the leg portions 32 and 34 maintain the longitudinal spacing between the leg portions of adjacent sections. The resilience of the elongated members 50 allows controlled pivotal, transverse and longitudinal elastic movement of the leg portions 32 and 34 relative to the elongated members 50 and each other where the coupling elements 22 and 24 are bent by the slider 20; this insures easy and reliable operation.

The spacing between the elongated members 50 and the connecting portions 36 and the longitudinal dimensional stability of the members 50 results in cooperation between the members 50 and portions 36 to maintain the coupling elements 22 and 24 generally straight and to control head to head skew without substantially degrading the flexibility of the coupling elements 22 and 24. The central location of the members 50 allows greatly improved flexibility of the slide fastener since tapes having stiffness or resistance to transverse bending can be eliminated or replaced by more flexible tapes. Further, elimination of the necessity of strong tapes can reduce curvature of the fasteners due to torque of the tapes on the coupling elements.

Longitudinal and transverse forces applied to the head portions 30 by crosswise stress on the slide fasteners is distributed and transfered by the elongated members 50 both between the leg portions 32 and 34 of each section and between the leg portions of adjoining sections; such distribution increasing the crosswise strength of the slide fastener.

With the meander-type coupling elements 22 and 24 the elongated members 50 can be inserted between the leg portions 32 and 34 from the heel side of the coupling elements 22 and 24 either during or after formation of the coupling elements 22 and 24. Present manufacturing machinery and presses for forming meander type coupling elements need not be redesigned to form the filament about a longitudinal member into a coupling element. The formation of the grooves 54 and 56 and the guiding of the elongated members 50 between the leg portions 32 and 34 can be accomplished by relatively simple modification of present meander type coupling element manufacturing apparatus and processes.

The elongated members 50 provide the function normally associated with the carrier tapes of prior art slide fasteners. Thus, the necessity of carrier tapes providing longitudinal and transverse dimensional stability to the slide fastener is eliminated. Attaching portions or tapes 26 and 28 for the slide fasteners can be knitted materials, relatively sheer materials, edge portions of a garment seam, or the like, which do not offer any substantial stability to the coupling elements 22 and 24; thus the attaching portions 26 and 28 can be selected to avoid degrading the appearance of the garment without deteriorating slide fastener strength and performance.

A modification of the slide fastener as shown in FIG. 5, has parts identified by numerals used to identify parts in FIG. 3, indicating that such parts have similar structure and function. In the modification of FIG. 5, the attachment portion or tape 28 is folded to form an underneath folded portion 64 to which the coupling element 24 is attached by the threads 38, 40, 42 and 44. Thus, the adjacent edges of tapes of a slide fastener employing the modification of FIG. 5 are folded and hide the coupling elements to produce the appearance of a sewn garment seam. Also it is noted that the leg portion 32 of the modification of FIG. 5 does not have any groove or teeth formed thereon.

Variations of the groove and teeth which may be formed in one or both leg portions 32 and 34 to grip the elongated member are illustrated in FIGS. 6, 7, 8, 9, 10, 11, 12, and 13. In the variation of FIGS. 6 and 7, a central V-shaped groove 66 and smaller parallel contiguous V-shaped grooves 68 and 70 are formed by cutting away surface portions of the leg 32 to produce sharp edges or teeth for gripping the member 50. A groove 72 with a rectangular cross section, shown in the variation of FIGS. 8 and 9 is cut in the leg portion 32 to form edges to grip and restrain the member 50. In FIGS. 10 and 11, a groove 74 having a sharp dovetail cross section is formed in the leg portion 32 to receive and grip the flexible member 50. A groove 76, FIGS. 12 and 13, similar to groove 74 except the groove 76 has a rounded cross section, is formed in the leg portion 32 of the variation of FIGS. 12 and 13 to grip the member 50.

Since many variations, modifications, and changes in detail may be made to the presently described embodiments, it is intended that all matter in the foregoing description or shown in the accompanying drawings be interpreted as illustrative and not in a limiting sense.

What is claimed is:

1. A stringer for a slide fastener comprising a tape-like attachment portion, a coupling element disposed along one edge of the attachment portion and being formed from a continuous filament into successive coupling sections;

said filament having a cross section with a curved outer boundary forming a curved outer surface on the filament;

each section having a head portion, a pair of leg portions extending from opposite sides of the head portion, and a connecting portion interconnecting to a leg portion of an adjoining section;

thread means securing each section to the attachment portion;

an elongated member extending in spaced relation to the connecting portion longitudinally throughout the length of the coupling element transversely between the pair of leg portions of each section and maintaining the pair of leg portions of each section in spaced relationship;

said pair of leg portions of each section being biased in gripping relationship against the elongated member;

sharp edge means formed in the curved surface on at least one of the pair of leg portions of each section and engaging the elongated member both longitudinally and transversely for restraining both longitudinal and transverse movement of the one leg portion of each section relative to the elongated member; and further said pair of leg portions of each section having respective segments between the sharp edge means and the connecting portions free of any restraint relative to each other.

2. A stringer for a slide fastener as claimed in claim 1 wherein the sharp edge means formed on the one leg portion deforms a portion of the elongated member and interlocks with the deformed portion of the elongated member.

3. A stringer for a slide fastener as claimed in claim 1 wherein the sharp edge means formed on the one leg portion of each section includes a detent deforming a portion of the elongated member to interlock with the one leg portion of each section.

4. A stringer for a slide fastener as claimed in claim 3 wherein each detent has a sharp edge interlocking with the elongated member.

5. A stringer for a slide fastener as claimed in claim 1 wherein the sharp edge means formed on the one leg portion of each section includes a tooth projecting from the one leg portion of each section and interlocking with the elongated member.

6. A stringer for a slide fastener as claimed in claim 1 wherein the sharp edge means formed on the one leg portion of each section includes a groove formed transversely in the one leg portion of each section parallel the elongated member;

said elongated member has a cross section which is substantially more resiliently deformable and larger in area than the area of the cross section of each groove; and said elongated member is forced into the respective grooves by the other leg portion of each section whereby the elongated member is resiliently distorted such that the edges of the grooves form an interlock with the elongated member.

7. A stringer for a slide fastener as claimed in claim 6 wherein the cross section of each groove is V-shaped and the cross section of each elongated member is round.

8. A stringer for a slide fastener as claimed in claim 6 wherein the sharp edge means formed on the one leg portion of each section includes a pair of teeth projecting from the one leg portion of each section at each side of the groove and interlocking with the elongated member.

9. A stringer for a slide fastener as claimed in claim 1 wherein both of the pair of leg portions of each section have sharp edge means formed on mutual facing surface portions for deforming a portion of the elongated member and for interlocking with the deformed portion of the elongated member to restrain both longitudinal and transverse movement of the pair of leg portions of each section relative to the elongated member.

10. A stringer for a slide fastener as claimed in claim 1 wherein the connecting portions of alternate sections extend in respective spaced planes parallel the attachment portions and interconnect leg portions extending in the respective spaced planes.

11. A slide fastener comprising a pair of stringers and a slider on the stringers for opening and closing the stringers wherein each stringer includes a tape;

a coupling element disposed along one edge of the tape and being formed from a continuous filament into successive coupling sections;

said filament having a cross section with a curved outer boundary forming a curved surface on the filament;

each section having a head portion, a pair of elongated parallel leg portions extending from opposed sides of the head portion, and a connecting portion interconnecting to a leg portion of an adjoining section;

both of said pair of leg portions extending in a plane perpendicular to the plane of the tape over a portion of one side of the tape adjacent to one edge of the tape;

thread means securing the pair of leg portions of each section to the one side portion of the tape;

an elongated flexible member being resilient in cross section and extending parallel to the attachment portion throughout the length of the coupling element between the pair of leg portions of each section for maintaining the pair of leg portions of each section in spaced relationship;

said pair of leg portions of each section having respective grooves formed in the curved surfaces thereof for receiving the elongated member;

said grooves having a V-shaped cross section substantially less in area than the area of the cross section of the elongated member;

a pair of teeth projecting from each leg portion of each section on the opposite sides of the groove;

said pair of leg portions of each section being biased against the elongated member such that the elongated member is deformed by the teeth and into the grooves to form an interlock both longitudinally and transversely between the elongated member and the pairs of leg portions;

each of said teeth and respective sides of the respective grooves defining a planar surface engaging a substantial surface portion of the elongated member; and further said pair of leg portions of each section having respective segments between the teeth and the connecting portions free of any restraint relative to each other.

* * * * *